US006907905B2

(12) United States Patent
Lumello

(10) Patent No.: US 6,907,905 B2
(45) Date of Patent: Jun. 21, 2005

(54) MANIFOLD OF A PLASTICS MATERIAL FOR HOT-WATER HEATING SYSTEM AND THE LIKE

(75) Inventor: Carlo Lumello, Valduggia (IT)

(73) Assignee: Onda Engineering System S.r.l., Vercelli (IT)

( * ) Notice: Subject to any disclaimer, the term of this patent is extended or adjusted under 35 U.S.C. 154(b) by 0 days.

(21) Appl. No.: 10/726,587

(22) Filed: Dec. 4, 2003

(65) Prior Publication Data

US 2004/0107921 A1 Jun. 10, 2004

(30) Foreign Application Priority Data

Dec. 4, 2002 (IT) ..... TO2002A1059

(51) Int. Cl.[7] ..... F16K 11/10
(52) U.S. Cl. ..... 137/883
(58) Field of Search ..... 122/235.11, 235.15, 122/235.18; 137/561 A, 255, 266, 267, 883, 271

(56) References Cited

U.S. PATENT DOCUMENTS 4,524,807 A * 6/1985 Toliusis ..... 137/884
4,631,212 A * 12/1986 Shifflett et al. ..... 428/35.8
5,868,439 A 2/1999 Schmidt
6,089,263 A 7/2000 Dumser
6,578,605 B2 * 6/2003 Cooper et al. ..... 137/625.5
6,736,165 B2 * 5/2004 Bender ..... 137/883

FOREIGN PATENT DOCUMENTS

| | | |
|---|---|---|
| DE | 3043422 A | 7/1982 |
| DE | 19608781 A | 9/1996 |
| DE | 20014321 U | 1/2002 |
| WO | WO 9416252 A | 7/1994 |
| WO | WO 0057097 A | 9/2000 |

* cited by examiner

*Primary Examiner*—Jiping Lu
(74) *Attorney, Agent, or Firm*—Sughrue Mion, PLLC

(57) ABSTRACT

The manifold includes a sleeve element (10) extending longitudinally about an axis (x), formed in one piece of plastics material and having a plurality of pairs of apertures (11, 12) distributed along the manifold. The apertures of each pair are aligned transversely with each other for engaging and locking on the manifold respective pairs of tubular metal elements (20, 30) connectable mechanically the one to the other (16) and to a branch (T) of the heating system.

5 Claims, 5 Drawing Sheets

MANIFOLD OF A PLASTICS MATERIAL FOR HOT-WATER HEATING SYSTEM AND THE LIKE

BACKGROUND OF THE INVENTION

The present invention relates to a plastic manifold for hot-water heating systems and the like.

In the prior art manifolds are made of metal and are cast or made by drawing and additional operations. Such manifolds are used not only in the circuits of heating systems using radiators but also in heating systems using floor or wall-mounted coils or radiant panels, which can also be used to cool rooms during summer months, by using cold water. The main disadvantage of metal manifolds consists in their use in the latter category of systems: circulation of a fluid at a temperature lower than the ambient temperature inevitably leads to condensation on the outer surface of the manifolds. In turn, this condensation causes infiltration of damp patches on the walls or on the floor where the manifold assemblies are fitted or embedded. In addition, the use of metal material and the need for special operations mean that this type of manifold involves considerable costs.

In order to reduce condensation and, as a secondary benefit, to reduce the cost of these products, manifolds have recently been proposed made of batteries of modular elements moulded in plastics material working this type of material is definitely less expensive, while the better insulating properties of plastics materials significantly reduce the problem of condensation.

In order better to understand the art and the problems inherent thereto, a description is first provided of modular units of a known type, with reference to FIGS. 1 and 2 of the appended drawings.

The modular units of the type illustrated in FIGS. 1 and 2 include a main body 1 in the shape of a sleeve open at each end, having a generally horizontal axis and forming internally a tubular diametral portion 2. The bottom end of the tubular portion 2 is fitted to a threaded pipe coupling 3 for connection to a pipe, indicated T of a secondary circuit; a seat 4 for a valve, indicated 5 and 6 respectively in FIGS. 1 and 2, is formed in the upper end of the tubular portion. The internal opening 7 of the tubular portion is in communication with the cavity of the main body and is shaped in such a way that fluid coming from the manifold, if the unit is a delivery one (FIG. 1) or from a secondary circuit if the unit is a return one (FIG. 2) flows first through the seat 4 of the valve. Both types of modular unit are constituted by a single piece of moulded plastics material, except for the pipe coupling 3 which is made of metal, generally brass, which is embedded in the plastics material at the time of the moulding operation, with a ribbed root portion 8.

The individual units are mounted in succession along the axis y, with O-ring type sealing elements 9 mounted between the modules to ensure they are fluid tight. These units make up horizontal batteries which act as water delivery or return manifolds and, as individual units, as flow dividers for the secondary circuits connected to them. In delivery manifolds having units of the type shown in FIG. 1, water enters the battery at one end and leaves through the pipe couplings to supply the various branches of the heating system. The circuit of each individual branch can be excluded from the water circulation by means of respective shut-off valves 5. In return manifolds, on the other hand, which are composed of units of the type shown in FIG. 2, the water returns from the various branches of the system through the pipe couplings of the respective modular units and flows out through one end of the battery. The flow through the individual circuits is regulated by respective regulator valves 6. Brackets then secure the batteries, as part of a modular assembly, to a support structure fixed to a wall.

The modular arrangement of the manifold assemblies provides flexibility in use and makes it possible to absorb the overall heat expansion of the batteries at the interface of the individual modules, since the O-ring seals are able to deform and still ensure a hydraulic seal.

The main disadvantage of the modular arrangement consists in the possibility of leaks in the connection portions between modules and the consequent need for complicated and expensive maintenance. Another disadvantage, connected on the other hand to the construction methods of the individual modules, consists in the fact that inevitable variations in cyclical heat expansion, due to the different heat expansion coefficients of plastics materials and metal, can cause detachments at the interface of the plastic body and the ribs of the metal pipe couplings, which then lead to fluid leakage. In such an event it is necessary to replace the module.

SUMMARY OF THE INVENTION

The object of the invention is therefore to provide a moulded plastics manifold which overcomes the above-described disadvantages of to the prior art.

BRIEF DESCRIPTION OF THE DRAWINGS

The structural and operating characteristics of a preferred embodiment of the invention will now be described with reference to the appended drawings, in which.

DETAILED DESCRIPTION OF THE INVENTION

Figure 3:
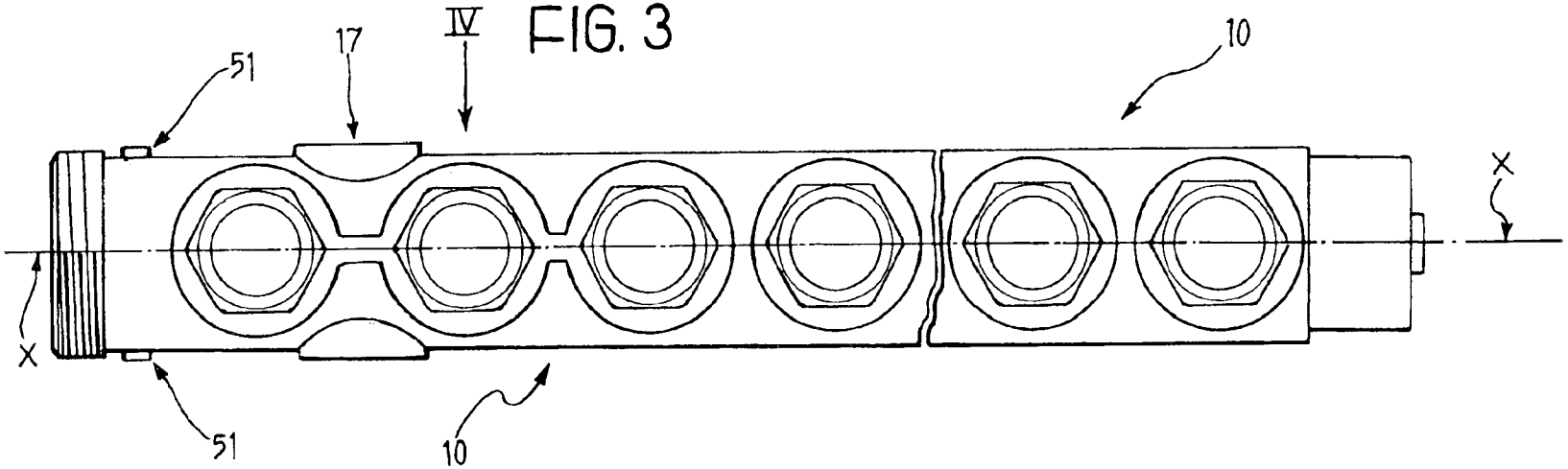
FIG. 3 is a side view of a manifold of the invention.

In the description and in the appended Claims, terms and expressions indicating positions or orientations such as "longitudinal", "axial", "radial" or "transverse" should be understood as referring to the longitudinal axis x of a manifold 10, as shown in FIG. 3.

Figure 1:
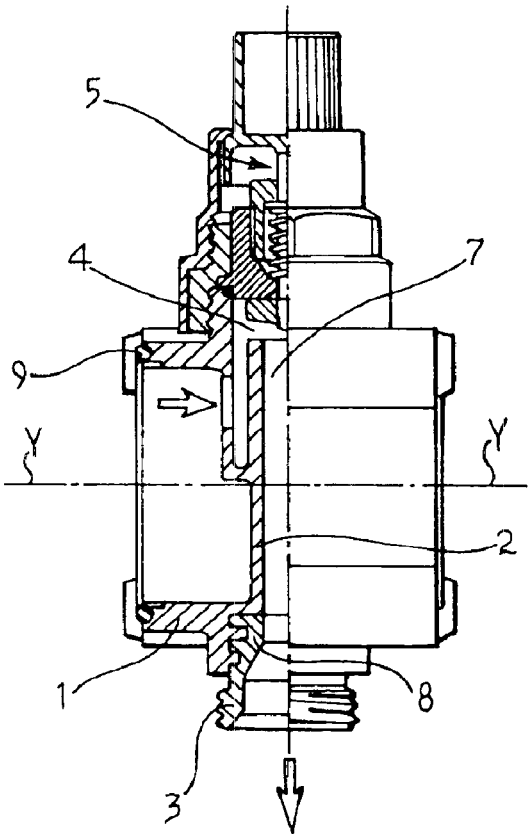
FIG. 1 (PRIOR ART)
FIGS. 1 and 2 are axial section views of two modular units of a known type for making up delivery and return manifold assemblies for heating systems.
Figure 2:
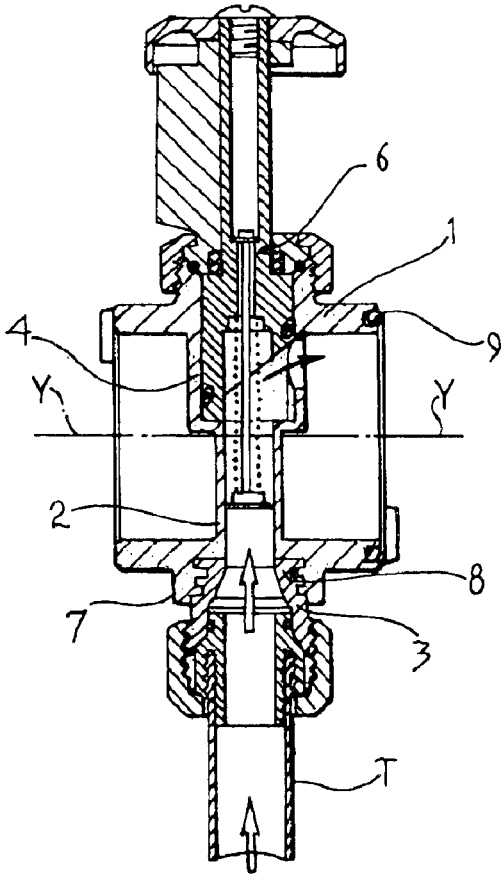
FIG. 2 (PRIOR ART)
Figure 4:
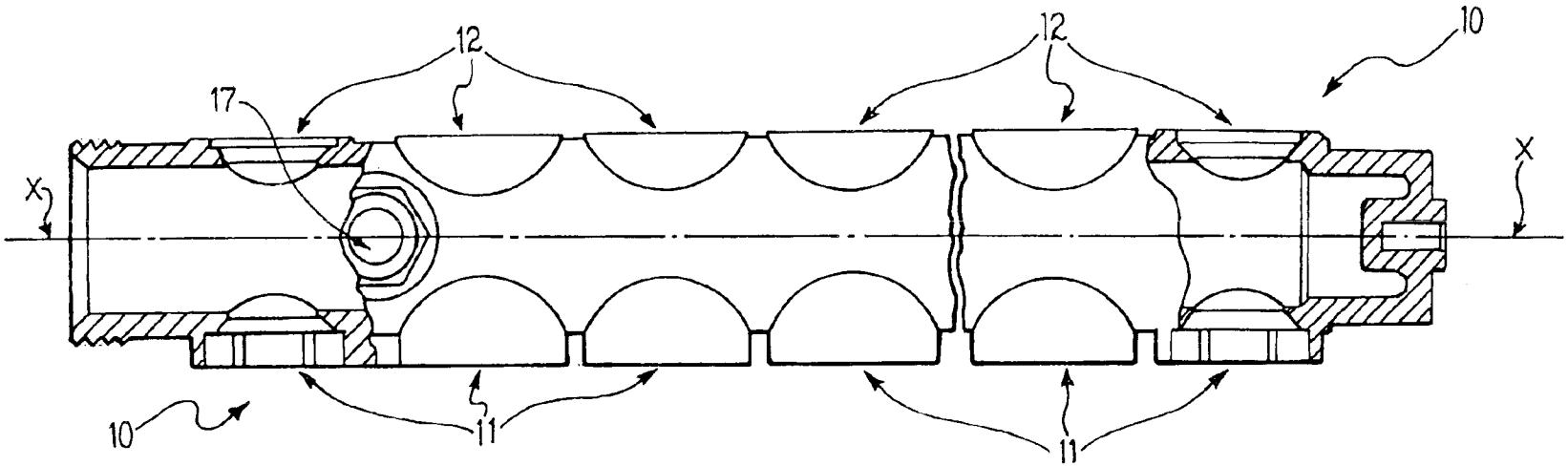
FIG. 4 is a side view of the manifold, with a partial axial section taken along the arrow IV of FIG. 3.

With reference to FIGS. 3 and 4, the longitudinally extending manifold 10 is in the shape of a generally tubular sleeve and is constituted by a single piece of shaped moulded plastics material. The manifold 10, which can serve equally as a delivery or return manifold, is open at a first end (on the left in the drawings) for the intake (in a delivery manifold) or for the exit of water (in a return manifold) while the opposite end is closed.

On two diametrically opposite sides the manifold has a respective series of apertures, indicated 11 in the lower series and 12 in the upper. The apertures of a series are aligned longitudinally and each aperture is aligned transversely or diametrically with a corresponding aperture in the opposite series, both longitudinally in the same series and radially, by pairing each aperture of the one series with one from the other. The two parallel planes in which the apertures lie are generally horizontal in the installed condition. Near the open end of the manifold (on the left in FIGS. 3 and 4) an additional aperture 17 is formed, in a side of the manifold lying in a plane orthogonal to those in which the two series of apertures 11 and 12 are formed. This additional hole 17 is provided for mounting a thermometer 18, shown in FIG. 6. Again near the open end, two diametrically opposite cylindrical projections, indicated 51 in FIG. 3 and the function of which will be explained later, are formed in the external surface of the manifold.

Figure 5:
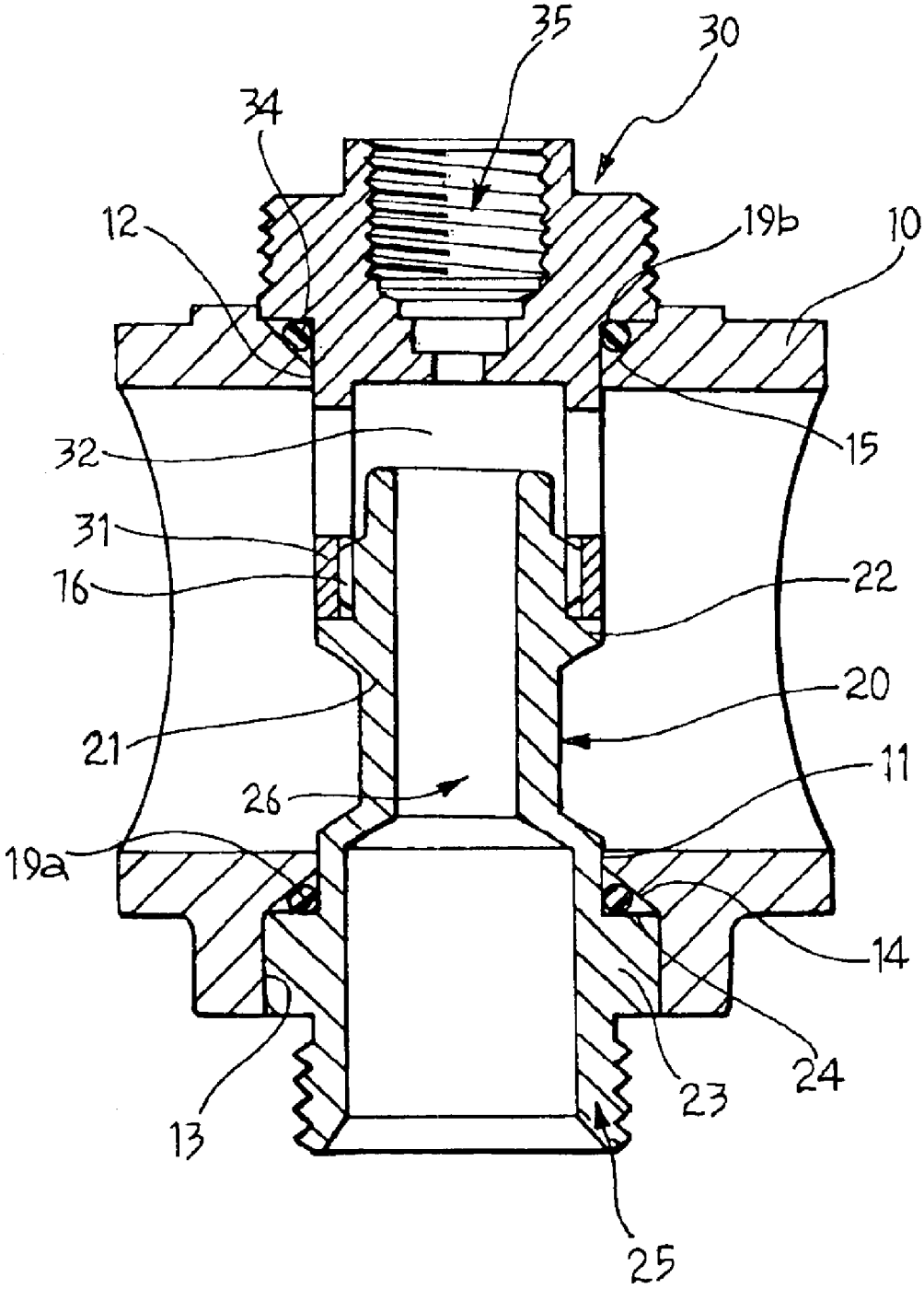
FIG. 5 is an axially sectioned view of a portion of the manifold of FIG. 3, in which two metal elements are mounted for containing a valve mechanism and for connection to a secondary circuit.

One portion of the manifold assembly will now be considered in greater detail, with reference to FIG. 5. The aperture 11 is provided for fitting a lower metal element or body 20, while the aperture 12, aligned with 11, is provided for inserting an upper metal element or body 30. The two metal elements 20, 30, aligned with respect to the same axis as the two apertures 11, 12, are each constituted by an essentially tubular body with portions having sections of different diameters, both internal and external. The body 20 provides connection to the pipe (not shown) of a secondary circuit, by means of a threaded pipe coupling 25 formed at the lower end of the body; the body 30, on the other hand, makes it possible to engage the stopper mechanism of a valve (not shown) in a seat 35 in its outermost end.

In particular, the two metal bodies 20, 30 have two tubular portions, indicated 21 and 31 respectively, which make it possible to couple the two metal elements together inside the manifold 10 by means of a thread 16. Beneath the thread 16, the tubular portion 21 has an abutment collar 22 for the portion 31 of the upper body 30. Engaged in the body of the manifold 10 and coupled together, the two metal bodies form an essentially tubular cross member the internal cavity of which is in communication with the main duct of the manifold by means of a transfer passage 32 formed in the tubular portion 31 of the body 30. The overall dimensions of the tubular cross member are calculated to allow a free passage section for the main flow through the manifold. The sectioned portions shown in FIG. 7, make it possible to appreciate the dimensions of the section of the duct 32 and the free passage section through the manifold, indicated 36; in this drawing the overall tubular cross member is indicated 50.

Still referring to FIG. 5, the end of the portion 21, which partially protrudes into the communication duct 32, forms a seat in which can operate the shutter of a valve mechanism (not shown) to be engaged in the seat 35 of the body 30. The shutter makes it possible to open, partially open or close the opening of a coaxial duct 26 inside the portion 21 of the lower body 20. The duct 26 puts the manifold 10 in communication with a branch of the heating system, connected to the pipe coupling 25. The valve mechanism can be selected as a shut-off valve, if associated with a delivery manifold, or as a regulator valve if associated with a return manifold. Different elements, such as a breather valve (not shown) can also be engaged.

In addition, the body 20 has a prismatic portion 23, hexagonal in cross section, for coupling to the manifold 10 at the aperture 11, where a correspondingly shaped prismatic housing 13 is formed. This connection ensures that the body 20 is secured to the manifold 10 and locked against relative rotation. This makes it far simpler to fit or dismantle the element 30 or the connector pipe of a secondary circuit.

Turning in detail to the structure of the aperture 11, a conical surface 14, tapered or converging towards the circular aperture 11, is formed in the tubular wall of the main body 10, in a radial position relative to the seat 13. An annular circular seal element or O-ring 19*a* is resiliently compressed between the conical surface 14 and a shoulder 24. The deformation of the O-ring 19*a* ensures an hermetic seal between the plastic manifold 10 and the lower metal body 20 when, screwed tight to the upper metal body 30, this latter compresses the said seal against the surface 14. In the same way, the hermetic seal between the plastics manifold 10 and the metal element 30 is ensured by an O-ring 19*b* resiliently compressed between a conical surface 15, tapering or converging towards the second side aperture 12, and a shoulder surface 34 of the body 30. By compressing the two O-rings 19*a*, 19*b* at the same time, the screwing together of the two metal bodies 20, 30 ensures a fluid-tight seal.

The O-ring seal elements 19*a*, 19*b* ensure that the interface areas between the metal parts 20, 30 and the plastics manifold 10 are fluid tight, despite any variation in thermal expansion of the two materials. The cyclical nature of this stress, due to alternating heating and cooling periods, does not affect fluid tightness thanks to the resilient properties of the O-rings, while any wear of the plastics material of the manifold 10 at the join with the metal elements 20, 30 does not affect fluid tightness either, since it is compensated by the O-rings.

Figure 6:
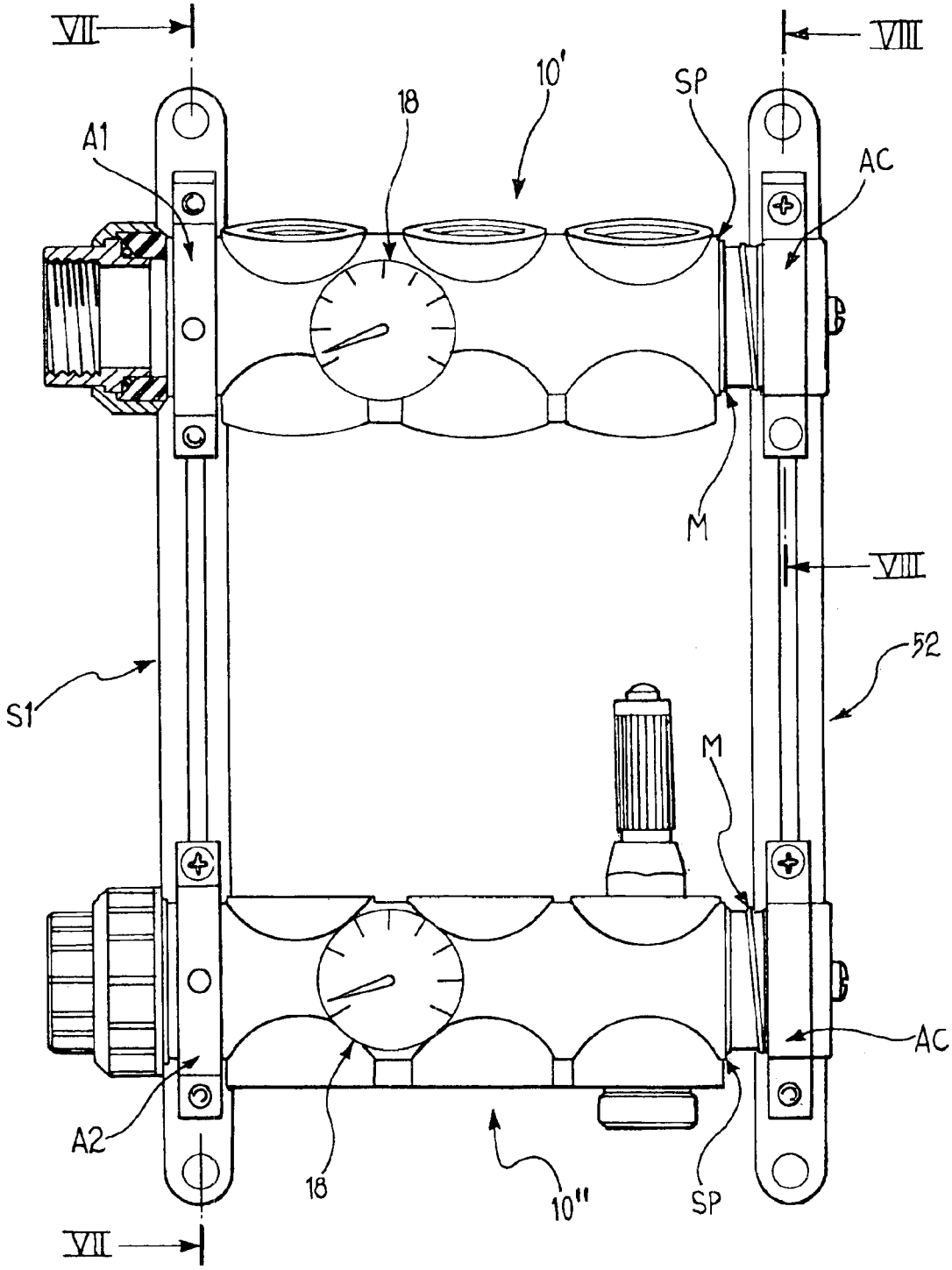
FIG. 6 is a front view of two manifolds, one delivery and one return, in their fitted condition.
Figure 7:
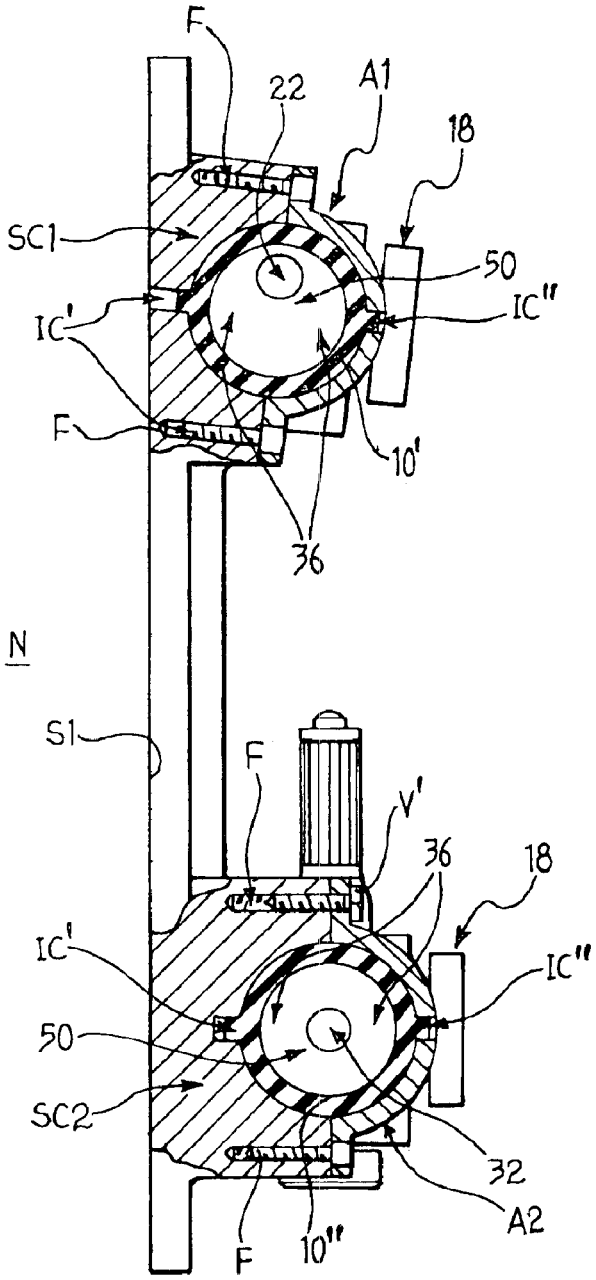
FIG. 7 is a section view taken on the line VII—VII of FIG. 6.
Figure 8:
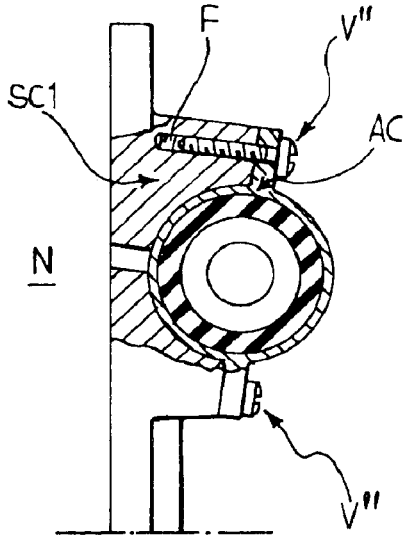
FIG. 8 is a section view taken on the line VIII—VIII of FIG. 6.

In FIGS. 6, 7 and 8 an upper delivery manifold 10' and a return manifold 10" are fixed to a wall structure N (see FIGS. 7, 8) by means of a pair of double vertical brackets S1, S2. In general, each double bracket is constituted by two seats SC1, SC2 each consisting of a half-cylindrical cavity with a horizontal axis and each having a cylindrical hole IC' in the bottom of the cavity. The manifolds 10' and 10" are housed in these respective cavities SC1, SC2. The ends of the two manifolds are fixed to the double bracket S1 by means of two half-rings A1, A2 which each also have a cylindrical-section hole, indicated IC", diametrically opposite the hole IC' of the corresponding twin cavity SC1, SC2. The cylindrical projections 51 of the left ends of the manifolds are engaged in the holes IC', IC", thereby securing the connection of the two manifolds 10', 10" to the bracket S1. Each of the two half-rings A1, A2 is then fixed to the double bracket by means of two screws V' engaged in appropriate seats F.

In order to allow the manifolds to expand longitudinally during the heating and cooling operating cycles, the blind ends of the manifolds 10', 10", associated with the double bracket S2 (on the right in FIG. 6) are mounted slidably through two cylindrical rings AC, secured to the body of the bracket by screws V". The manifolds are thus rigidly secured by their left ends, which connect them to the boiler or to the temperature regulating device, while their blind ends, on the right in the drawings, are free to slide longitudinally.

Finally, a resilient element, a coil spring M in this example (see FIG. 6), can be fitted onto the blind end of each manifold 10', 10" so as to be compressed axially between a support ring AC and a shoulder SP, formed on the outer surface of the manifold.

The assembly configuration shown in FIG. 6 avoids stress building up in the plastics manifolds, which stress could occur during the heating and cooling cycles if the manifolds were rigidly secured at both ends.

The invention therefore makes it possible to produce a monobloc manifold element simply and economically, by moulding it in one piece of plastics material, with the possibility of fitting a plurality of valve elements of various types, each with pipe couplings for connection to respective secondary branches of the system.

The plastics material preferably includes polyarylamide reinforced with glass fibre in order to improve mechanical strength. The advantages of the prior art are retained: the low heat conduction of the plastics material considerably reduces condensation, as referred to in the introductory part of this description, while the relatively low cost of the plastics material provides a considerable saving compared to conventional monobloc manifolds made of metal.

The production of the manifold as a single block body, according to the invention, reduces the number of connections requiring a fluid-tight seal, since there are no modular units to assemble, while fluid tightness between the metal parts of the valve elements and the plastics material of the manifold is ensured by the O-rings, independently of the degree of difference in thermal expansion between the two materials. This arrangement eliminates once and for all the danger of the plastics material and the metal becoming detached and, in addition, a fluid-tight seal is ensured even if the plastics material becomes worn at the interface with the metal element.

Fitting and dismantling the valve elements is also far simpler, as are any maintenance operations. In particular, it should be noted that should one of the O-rings deteriorate, it can easily be replaced, by removing the valve mechanism without having to replace any other components of the manifold assembly. In the prior art, should a leak occur in the same area of the manifold (the join between plastics material and metal), the only solution would be to replace the faulty modular unit.

Although one, preferred embodiment has been described with reference to the appended drawings, it is clear that this description has been provided purely by way of non-limitative example, and that numerous variations can be made to the invention with regard to shape, dimensions, arrangement of parts and manufacturing details. For example, the number of apertures on the manifold can vary in dependence on requirements, as can the shape of the manifold in cross section. In the same way, manufacturing and operating characteristics of the valve mechanisms can be of any type (shut-off or regulator valves, manually controlled or controlled electrically by means of an associated thermostat).

What is claimed is:

1. A manifold assembly for a hot-water heating system including:

a manifold (10) including a sleeve element extending longitudinally about an axis (x), formed in one piece and having a plurality of pairs of apertures (11, 12) distributed along the manifold, wherein the apertures of each pair are aligned transversely with each other;

pairs of first and second tubular metal elements (20, 30) engaged in the said pairs of apertures (11, 12) in the manifold and mechanically coupled the one to the other by threaded means (16); and an annular seal element **(19*a*, 19*b*) interposed between each tubular metal element (20, 30)** and a respective surface of the manifold to provide a seal in the region of the aperture.

2. The manifold assembly of claim 1, wherein each seal element **(19*a*, 19*b*)** resiliently compressed by reason of said threaded means.

3. The manifold assembly of claim 1, wherein each seal element **(19*a*, 19*b*) engages against surface (14, 15)** of the manifold tapering inwardly thereof.

4. The manifold assembly of claim 3, wherein the tapered surface is a conical a surface.

5. The manifold assembly of claim 1, wherein a prismatic seat (13) is formed at the site of one (11) of each pair of apertures (11, 12) for securing a corresponding portion (23) of a tubular metal element (20) against rotation.

* * * * *